United States Patent [19]

Lempio

[11] 4,223,610

[45] Sep. 23, 1980

[54] ACTUATED SECONDARY DOG FOR POWER AND FREE CONVEYOR SYSTEM

[75] Inventor: George D. Lempio, Overland Park, Kans.

[73] Assignee: Mid-West Conveyor Company, Inc., Kansas City, Kans.

[21] Appl. No.: 33,269

[22] Filed: Apr. 25, 1979

[51] Int. Cl.[3] ..... B61B 12/02; B61B 10/02; B61B 13/00

[52] U.S. Cl. ..... 104/172 S; 104/91; 104/96

[58] Field of Search ..... 198/177 R, 177 T; 104/172 S, 172 B, 172 BT, 178, 89, 91, 93, 94, 95, 96, 108; 105/148, 150, 151, 153, 155

[56] References Cited

U.S. PATENT DOCUMENTS

| | | | |
|---|---|---|---|
| 3,195,473 | 7/1965 | Dehne | 104/91 |
| 3,229,645 | 1/1966 | Dehne | 104/172 B |
| 3,314,377 | 4/1967 | Dehne | 104/96 |
| 3,314,378 | 4/1967 | Potter et al. | 104/96 |
| 3,451,352 | 6/1969 | Curry et al. | 104/172 R |
| 3,602,148 | 8/1971 | Swartz | 104/96 |
| 3,618,532 | 11/1971 | Clewett et al. | 104/172 S |
| 3,640,226 | 2/1972 | Klamp | 104/96 |
| 3,662,873 | 5/1972 | Ross | 104/172 R |
| 3,726,233 | 4/1973 | Swartz | 104/172 S |
| 3,741,126 | 6/1973 | Ross | 104/96 |
| 3,818,840 | 6/1974 | Dehne | 104/172 S |
| 3,861,323 | 1/1975 | Turner | 104/172 S |
| 3,889,606 | 6/1975 | Linton | 104/172 S |
| 3,906,867 | 9/1975 | Knudsen | 104/172 S |
| 3,915,287 | 10/1975 | Seymour et al. | 104/172 S |
| 4,031,829 | 6/1977 | Bell et al. | 104/172 S |
| 4,072,111 | 2/1978 | Hoehn | 104/172 |

FOREIGN PATENT DOCUMENTS

| | | | |
|---|---|---|---|
| 1296098 | 5/1969 | Fed. Rep. of Germany | 104/172 |

*Primary Examiner*—Richard A. Bertsch
*Attorney, Agent, or Firm*—Fishburn, Gold and Litman

[57] ABSTRACT

A power and free conveyor system wherein a train of track supported trolleys includes a lead trolley normally driven by an overhead power chain. The train moves through a transfer area wherein the lead trolley is disengaged from the power chain; and, in order to complete the transfer, a trailing trolley is provided with a secondary or transfer dog which engages the power chain while the lead trolley is undriven. The transfer dog is pivotally connected to one end of an operating arm which is pivotally mounted on a lower portion of the trailing trolley, and the other end of the operating arm supports a cam follower. An actuating cam extends below the track in the transfer area, causing the transfer dog to rise into a transfer position so as to engage the power chain and thereby propel the train through the transfer area.

11 Claims, 11 Drawing Figures

ACTUATED SECONDARY DOG FOR POWER AND FREE CONVEYOR SYSTEM

BACKGROUND OF THE INVENTION

The present invention relates to a power and free conveyor system and, more particularly, to an improved mechanism for transferring a train of free trolleys through an area wherein no power is applied to the normal drive trolley.

Power and free conveyor systems normally include trains of interconnected load bearing trolleys which ride upon a load bearing track and are driven by a power conveyor device in the form of a chain. The power conveyor chains are normally of an endless variety, and it is often required that the individual power chain sections be shorter than the desired travel distance of the trolleys, thereby requiring several such power chain sections. It is sometimes desired to transfer the load to a side track wherein no driving power is applied to the train. In addition, many conveyor systems also have switching stations whereat two or more tracks diverge from a single track and/or it is advantageous to vary the speed of the trolley train within the system, thus requiring separate power conveyor chains. In most conventional power and free conveyor systems of the type described herein a dog depends from the power conveyor chain and engages a power trolley, normally the lead trolley, as long as the lead trolley is beneath the power conveyor chain. However, whenever the train transfers between two different power chains or transfers onto a track having no power chain associated therewith, the lead trolley is no longer beneath the power conveyor and has no power applied thereto, at least temporarily. Therefore, a system is necessary to positively effect the transfer of the trolley train across the transfer area wherein no power is applied to the lead trolley.

Conventional methods for powering the trolley train across the transfer area have included such devices as pneumatic air cylinders which are tripped at the appropriate time and push the trolley train across the gap and/or downwardly sloping tracks wherein gravity is used to effect the transfer. The pneumatic devices along with other similar devices require complex machinery are usually expensive and machinery difficult to maintain. The downwardly sloping tracks also tend to be expensive in addition to being difficult to engineer and inappropriate for placement in many conveyor systems.

Another method for powering the trolley train across the transfer area includes: engagement of the original power conveyor chain by a trailing trolley after the power trolley has disengaged therefrom, driving the trolley train across the gap by means of this engagement of the trailing or transfer trolley and the original power chain, and disengaging the original power chain from the trailing trolley upon engagement of the power trolley with the second chain. An example of such a system is disclosed in the U.S. patent to Robert A. Hoehn, No. 4,072,111. The Hoehn system utilizes a cam depending from the upper flange of and into the track and a transfer dog pivotally attached to an upper part of the transfer trolley and having a cam follower on one end suitable for following the cam and raising the opposite end of the transfer dog into a position to engage the first power chain. The cam is selectively positioned such that the transfer dog is raised throughout the period required for transfer of the trolley train across the gap between the two power conveyor chains.

The Hoehn transfer system functions well for many types of conveyor systems; however, as the conveyor track, and hence trolley, becomes smaller the individual pieces thereof must be reduced in size. For small conveyor systems, the Hoehn device becomes structurally weak and difficult to engineer within the small volume available between the sides of the track of such smaller systems. Therefore, a transfer mechanism is desired which would be located substantially outside of the track. In addition, it is desired that no part of the transfer system extend above the track except when the actual transfer is taking place, thereby eliminating possible snagging by structural supports or by the power conveyor chain when such is not desired.

OBJECTS AND SUMMARY OF THE INVENTION

Therefore, the principal objects of the present invention are: to provide a transfer mechanism for a power and free conveyor system wherein a trailing trolley of a train of interconnected trolleys has a secondary or transfer dog which transfer dog is actuated to raise and engage a power conveyor chain, whenever it is necessary to transfer the trolley train through a region wherein no power is applied to a lead trolley of the train; to provide such a transfer mechanism wherein the actuating device for the transfer dog is substantially exterior of and below the track upon which the transfer trolley rides; to provide such a transfer mechanism which comprises a transfer dog extending vertically through the transfer trolley and pivotally attached to an operating lever at the bottom end thereof, the operating lever being pivotally attached to the body of the transfer trolley and having an opposite end thereof attached to and supporting a cam follower, and a cam depending downwardly from a trolley track and positioned so as to actuate the transfer dog during the appropriate transfer period, whenever the cam follower engages the cam; to provide such a transfer mechanism which does not extend above the trolley track except during the appropriate transfer period, wherein the transfer dog extends upwardly to engage the power conveyor chain; and to provide such a conveyor system and transfer mechanism therefor which are capable of extended useful lives, and are particularly well adapted for the proposed use thereof.

Other objects and advantages of this invention will become apparent from the following description taken in connection with the accompanying drawings wherein are set forth, by way of illustration and example, certain embodiments of this invention.

The drawings constitute a part of this specification and include exemplary embodiments of the present invention and illustrate various objects and features thereof.

DETAILED DESCRIPTION OF THE PREFERRED EMBODIMENT

Figure 1:
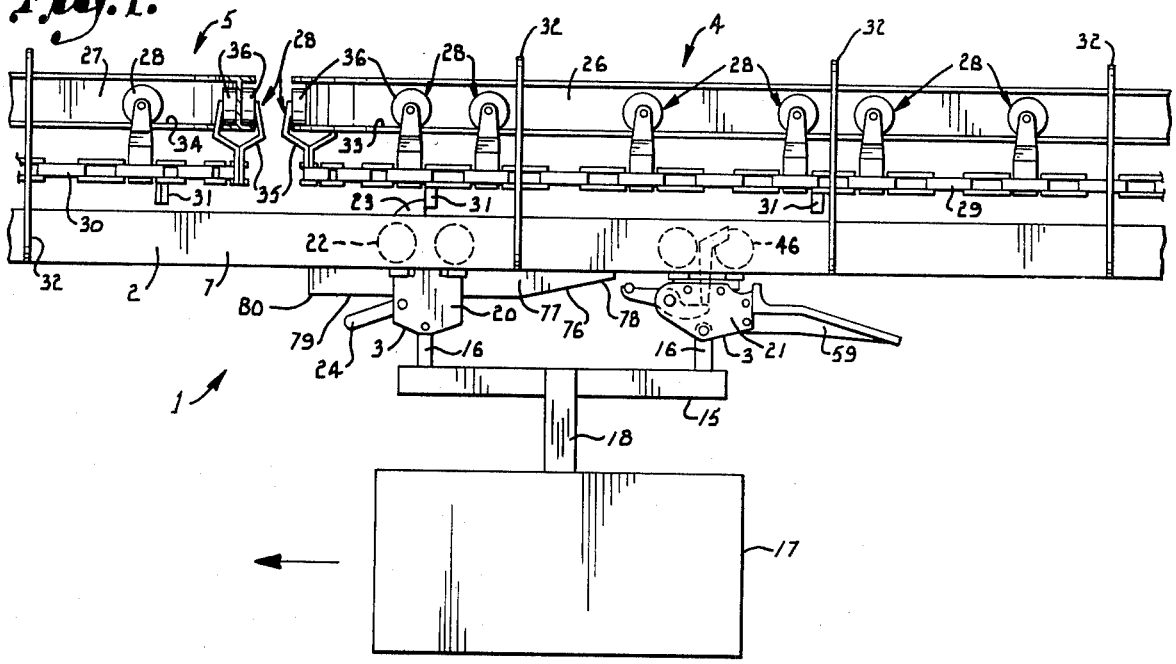
FIG. 1 is a side elevational view of a power and free conveyor system including two power conveyor chains, a load bearing track, power and trailing load bearing trolleys upon the load bearing track, and a transfer mechanism embodying the present invention wherein the load bearing trolleys are about to transfer between the two power conveyor chains.

As required, detailed embodiments of the present invention are disclosed herein, however, it is to be understood that the disclosed embodiments are merely exemplary of the invention which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

In general, power and free conveyor systems include a load supporting track, a plurality of interconnected load supporting trolleys riding upon the load supporting track (the free conveyor), at least one power means or device (the power conveyor) which is frequently a powered endless chain positioned above the load supporting track, and communicating means which is frequently comprised of interengaging dogs positioned on the power means and the trolley respectively for transferring power from the power means to the load supporting trolleys thereby driving same. Many power and free conveyor systems have divergent main tracks, side tracks, or change-of-power conveyors therein, such that transfer of the trolleys or carriers is necessary through a region where there is no overhead power means (a transfer area or region) thus requiring a transfer mechanism.

The terms "upper", "lower", "front", "rear", "forward", "trailing", "rearward" and derivatives thereof, as used herein for describing portions of the power and free conveyor system, are intended to apply to any such system that is oriented as shown in the drawings. In particular the term "forward" when referring to motion is the direction designated by the arrows in the figures.

Figure 2:
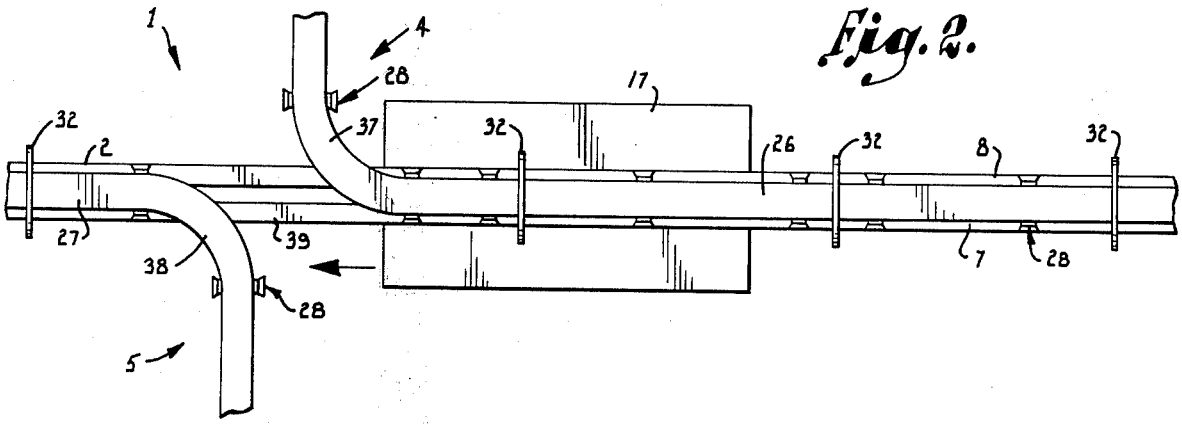
FIG. 2 is a top plan view of the power and free conveyor system shown in FIG. 1.

The reference numeral 1 generally designates a power and free conveyor system encompassing the present invention. As seen in FIGS. 1 and 2, the conveyor system 1 comprises a load bearing track 2, a multiplicity of interconnected load bearing trolleys 3, a first power means or device 4, and a second power means or device 5.

Figure 5:
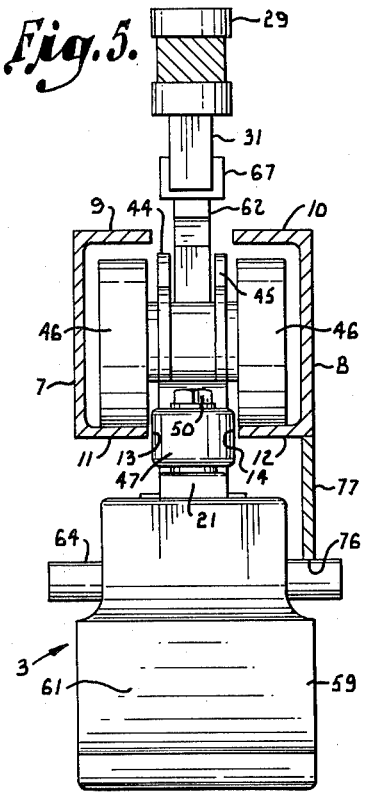
FIG. 5 is a partial cross-sectional view of the power and free conveyor system taken along line 5—5 of FIG. 3.

The load supporting or bearing track 2, see FIG. 5, comprises two parallel and confrontingly aligned C-beams or channel members 7 and 8. The channel members 7 and 8 are spaced a sufficient distance to allow free movement of the load bearing trolleys 3 therebetween. Each channel member 7 and 8 has an upper or top flange 9 and 10 and a lower or bottom flange 11 and 12 respectively. The bottom flanges 11 and 12 are parallel and horizontally spaced having interior facing edges 13 and 14 respectively.

The load bearing trolleys 3 are interconnected into trains by a support beam 15 pivotally connected to the trolleys 3 by hangers 16. A load 17 which is to be moved is connected to the support beam 15 by a load support hanger 18. As is illustrated in FIG. 1, there is a lead or power trolley 20 and a trailing or transfer trolley 21. Depending upon the actual number of trolleys 3 for any particular trolley train, the particular position of the power trolley 20 and transfer trolley 21 may vary relative to other trolleys contained in the train; however, it is required that the power trolley 20 and the transfer trolley 21 be individual and somewhat spaced from each other. The power trolley 20, illustrated in FIG. 1, has roller type wheels 22 which ride interiorly of the track 2 upon the lower flanges 11 and 12 thereof. The power trolley 20 has an upwardly extending primary or drive dog 23 adapted for engaging a member of the power devices 4 and 5, and is shown in FIG. 1 engaging the first power device 4. The power trolley 20 also has a release lever 24 which is operably connected to the drive dog 23. The release lever 24 operably lowers the drive dog 23 upon engagement with the trailing trolley of another trolley train (not shown) moving thereahead, thus releasing positive power therefrom and allowing the following trolley train to stop without ramming the other trolley train. The transfer trolley 21 will be discussed in greater detail hereinafter.

As illustrated in FIGS. 1 and 2, the first and second power devices 4 and 5 comprise I-beam tracks 26 and 27 respectively, a plurality of chain support trolleys 28 and power chains 29 and 30 respectively having power or pusher dogs 31 depending downwardly therefrom. The chain trolley tracks 26 and 27 are spaced at a substantially constant vertical distance from the load bearing track 2 by a plurality of track support beams 32. Each of the chain trolley tracks 26 and 27 has outwardly extending horizontal flanges 33 and 34 respectively on each side near the bottom thereof. Each chain trolley 28 comprises a Y-shaped yoke 35 terminating at the upper ends thereof with pivotally attached rollers or wheels 36. The chain trolley wheels 36 ride on the chain trolley tracks 26 and 27. The chain trolleys 28 are spaced along the chains 29 and 30, with concentrations thereof being positioned near the locations where the power dogs 31 depend from the chains 29 and 30. Each of the chains 29 and 30 is of an endless variety and can be driven by a conventional sprocket-motor combination (not shown). The power or pusher dogs 31 are tabs, projections, lugs, or similar devices fixedly attached to the chains 29 and 30 at spaced apart locations therealong and depending therefrom. The power dogs 31 thus normally travel at a fixed vertical distance above the load bearing track 2 as the chains 29 and 30 travel along thereabove.

The transfer trolley 21 normally trails behind and is separate from the lead or power trolley 20, as is illustrated in FIG. 1. However, it is common for additional trolleys (not shown) to be interspaced between the lead trolley 20 and the transfer trolley 21 or to follow the transfer trolley 21. It is the function of the transfer trolley 21 to provide driving power to the interconnected train of trolleys whenever propelling power is not applied to the normal lead or power trolley 20. In the portion of the power and free conveyor system shown in FIGS. 1 and 2, it is necessary to operatively drive the transfer trolley 21 when the lead or power trolley 20 becomes disengaged from one of the power dogs 31 on the first power system 4 in association with such a transfer. For the particular portion of the power and free conveyor system shown in FIGS. 1 and 2, transfer propulsion or driving power for the train must be provided until such time as the lead trolley 20 reengages one of the power dogs 31 on the second power system 5. In particular such a transfer occurs, as illustrated in FIG. 2, where the first power system 4 curves away from the trolley track 2 at the curved portion 37 and the second power system 5 converges with the trolley track 2 at the curved portion 38. The section of the track 2 between the two power systems 4 and 5 is referred to as the transfer station, region, or area 39. As used herein the term "transfer area" refers to a portion of the system 1 wherein no power is applied directly to the normal power trolley 20, but where it is still necessary or desirous to positively power the train. In the present invention, the transfer trolley 21 provides for positive propulsion and control of the train while the train is in or passing through the transfer area.

The transfer trolley 21 comprises a main body 41 having two downwardly extending parallel side plates 42 and 43, upwardly extending side plates 44 and 45, two pairs of vertically oriented rollers or wheels 46, a pair of horizontally oriented rollers or wheels 47, and a transfer mechanism 48. The body 41 has a base portion 49 which extends below and longitudinally along the track 2. The horizontal rollers 47 are pivotally mounted at opposite ends of the base 49 by bolts 50 or the like. A body upper portion 51 extends vertically upward from the base 49 between the channel members 7 and 8 and the upwardly extending side plates 44 and 45. The body upper portion 51 also extends outwardly over the horizontal rollers 47 at the upper end thereof. One pair of the vertical rollers 46 is pivotally attached to each side of the body upper portion 51 by bolts 53 or the like. The vertical rollers 46 are spaced, such that one pair rides on each of the bottom track flanges 11 and 12 respectively. The horizontal rollers 47 are positioned so that each rides somewhat loosely between facing edges 13 and 14 on flanges 11 and 12 respectively. The horizontal rollers 47 thus help to center the transfer trolley 21 in the middle of the track 2 and to avoid substantial contact of the transfer trolley 21 with the vertical sides of the track 2. A substantially vertical hollow core, channel, or bore 54 extends through the transfer trolley body 41. The upper portion of the bore 54 is defined by an aperture within the center of the body upper portion 51 and the upwardly extending side plates 44 and 45 which are secured to the body base 49 by bolts 55 or the like. The lower portion of the bore 54 is defined by an aperture through the body base 49. The lower side plates 42 and 43 are substantially flat and are also attached to opposite sides of the base 49 by the bolts 55 so as to positioned longitudinally with respect to the track 2 and parallel to one another. Each of the lower side plates 42 and 43 has an aperture (not shown) at the bottom thereof to which the load bearing hanger 16 is pivotally connected therebetween by a bolt 56 or the like. A pivot pin, bolt, or the like, here represented by bolt 57 and nut 58, passes through an aperture (not shown) in each of the lower side plates 42 and 43 and pivotally supports the transfer mechanism 48 therebetween. In the illustrated embodiment, a primary or drive dog release actuator 59 is attached, as by bolts 60, to the rearward end of each of the side plates 42 and 43. The actuator 59 has a sloping upper surface 61 suitable for engagement by the power trolley release lever 24 of a following train to thereby lower the lead trolley primary or drive dog 23. This disengages the primary dog 23 from a member of a heretofor engaged power system, such as one of the power dogs 31, so that the following trolley train will not be driven into a slower moving or stopped trolley train positioned in front thereof, thereby preventing damage to both and possible damage to the power system.

Figure 3:
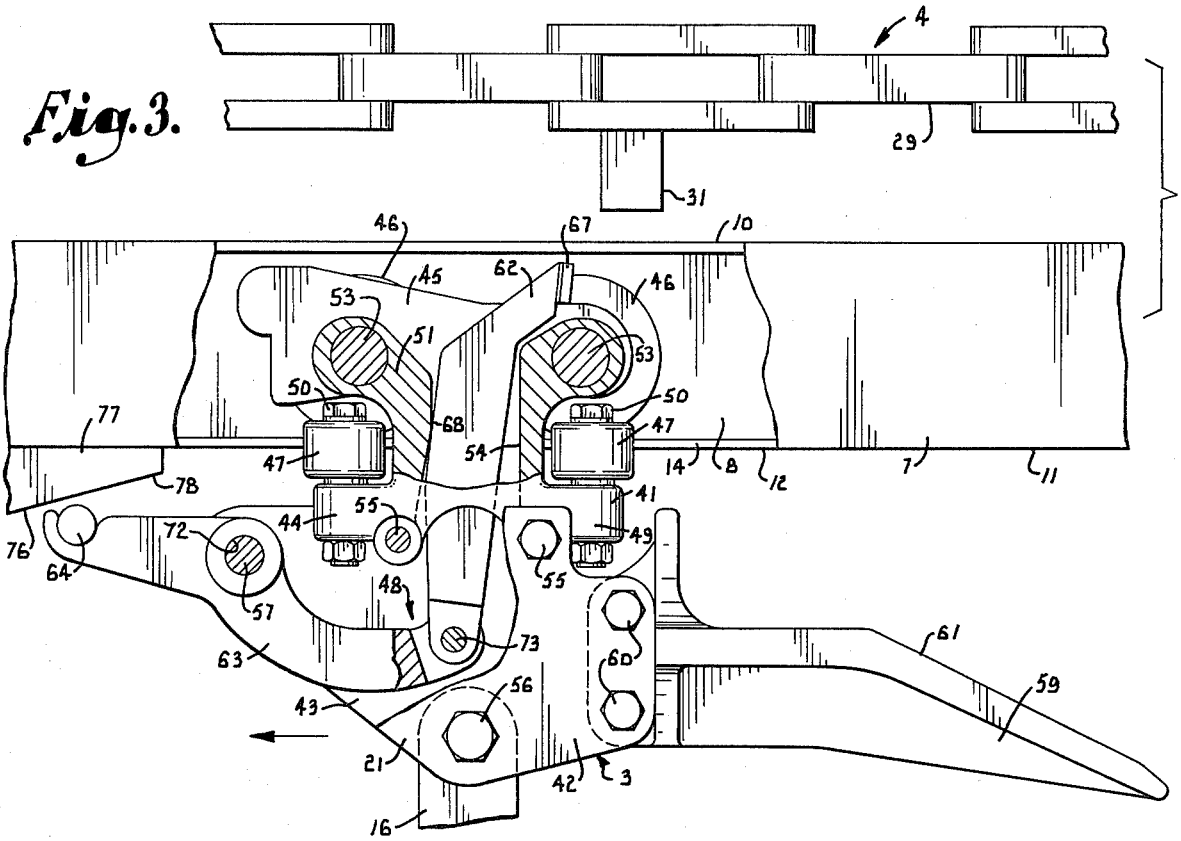
FIG. 3 is an enlarged side elevational view of the power and free conveyor system showing the trailing trolley with a transfer dog in a running position and having portions removed to show the details thereof.
Figure 6:
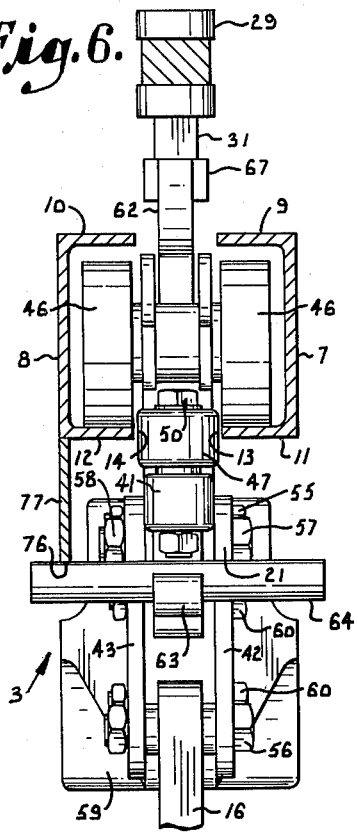
FIG. 6 is a cross-sectional view of the power and free conveyor system taken along line 6—6 of FIG. 3.
Figure 7:
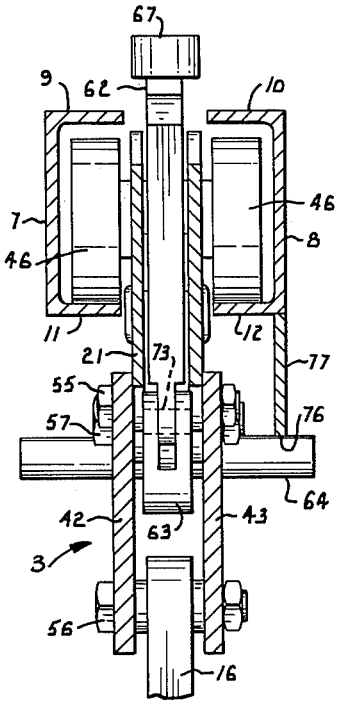
FIG. 7 is a cross-sectional view of the power and free conveyor system taken along line 7—7 of FIG. 3.
Figure 8:
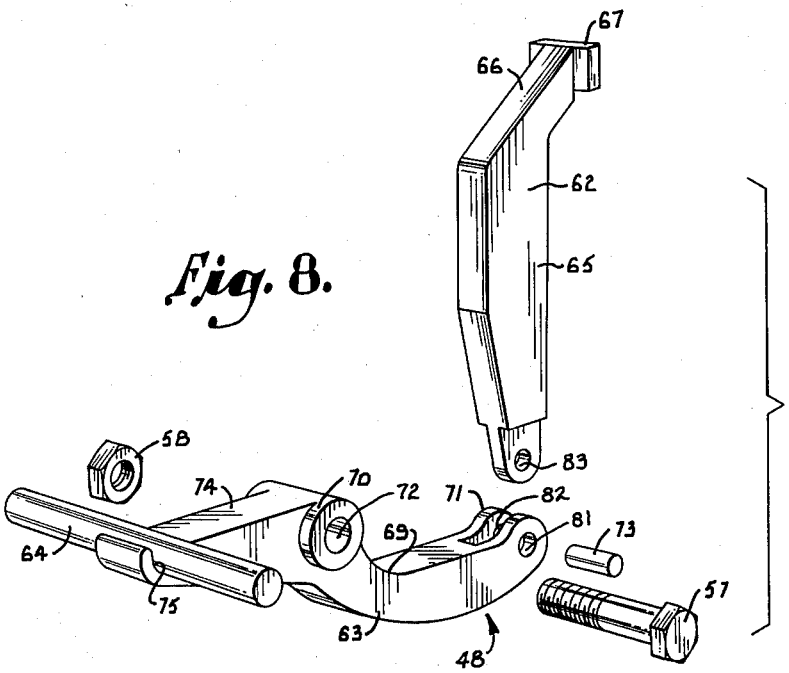
FIG. 8 is an exploded view of parts of the transfer mechanism, including the transfer dog.

The transfer mechanism 48 comprises a secondary or transfer dog 62, an operating lever 63, and a cam follower 64. In general the transfer dog 62 has a substantially vertical attitude and slidably engages the transfer trolley body 41, penetrating the bore 54 therein. The transfer dog 62 is free to slide vertically in the bore 54 and to extend outwardly from each side thereof. As is best seen in FIG. 8, the transfer dog 62 has a generally rectangular shaft 65 having a rearwardly and upwardly extending lug 66 attached to the top thereof. The rearmost edge or face 67 of lug 66 forms a substantially flat, vertical, and transversely aligned surface which is suitable for mating with one of the power dogs 31 of the first power system 4. The lug face 67 is preferably wider than the dog lug 66 or shaft 65, so that when one of first power system power dogs 31 is engaged therewith, there is less likelihood of same sliding therearound. The transfer dog 62 has an extended transfer or operating position, as best seen in FIGS. 5 and 6, wherein the lug 66 is positioned above the top flanges 9 and 10 of the track 2 and the lug face 67 is positioned in front of one of the power dogs 31 on the first power system 4, such that the transfer dog 62 will be engaged by such a power dog 31 moving in a horizontal plane relatively toward same. The transfer dog 62 has a retracted running or nonoperating position, as seen in FIG. 3, wherein the transfer dog 62 is positioned substantially entirely below the top flanges 9 and 10 of the track 2. In the transfer position the transfer dog 62 butts against a front side 68 of the transfer trolley bore 54 and is maintained in a vertical attitude thereby. When in the running position, the upper portion 51 of the transfer trolley 21 acts as a pocket or cradle for the transfer dog 62.

The operating lever 63, as is best seen in FIG. 8, is a substantially rigid elongated bar having a slightly curved portion 69 and is pivotally connected to the lower side plates 42 and 43 by the bolt 57, received through a transverse aperture 72 therein. A trunnion or shoulder 70 extends outwardly from each side of the operating lever 63 along the bolt 57 to provide extra structural support thereto. A rearward end 71 of the operating lever 63 is bifurcated and forms a yoke or clevis in conjunction with a pivotal fastener, illustrated as a pin 73, extending through apertures 81 and 82 therein and held in place by the lower side plates 42 and 43. The transfer dog 62 is pivotally attached near a lower end thereof to the operating lever 63 by the pin 73 which extends through an aperture 83 therein and thus pivots in the clevis formed at the rear end of the operating lever 63. A front end 74 of the operating lever 63 has an upwardly facing transverse channel 75 extending therethrough. The cam follower 64 is secured in the channel 75 and extends horizontally and traversely to the direction of movement of the transfer trolley 21. Preferably, the cam follower 64 is at all times vertically spaced below the track 2 so as not to wear thereon. As illustrated, the cam follower 64 is an elongate circular bar extending outwardly from the operating lever 63. It is foreseen that other types of cam followers could be readily substituted for the illustrated cam follower 64, such as a cam follower having bearings, a flat bar, etc. Thus, as illustrated, the transfer mechanism 48 is positioned substantially entirely below the track 2 except for that portion of the transfer dog 62 which extends upwardly between the track channel members 7 and 8. It is foreseen that the various parts of the transfer mechanism 62 and the various positions thereof could be altered substantially within the purview of the present invention; in particular, the operating lever 63 may extend rearwardly of the transfer dog 62 rather than frontwardly, as is illustrated.

Figure 4:
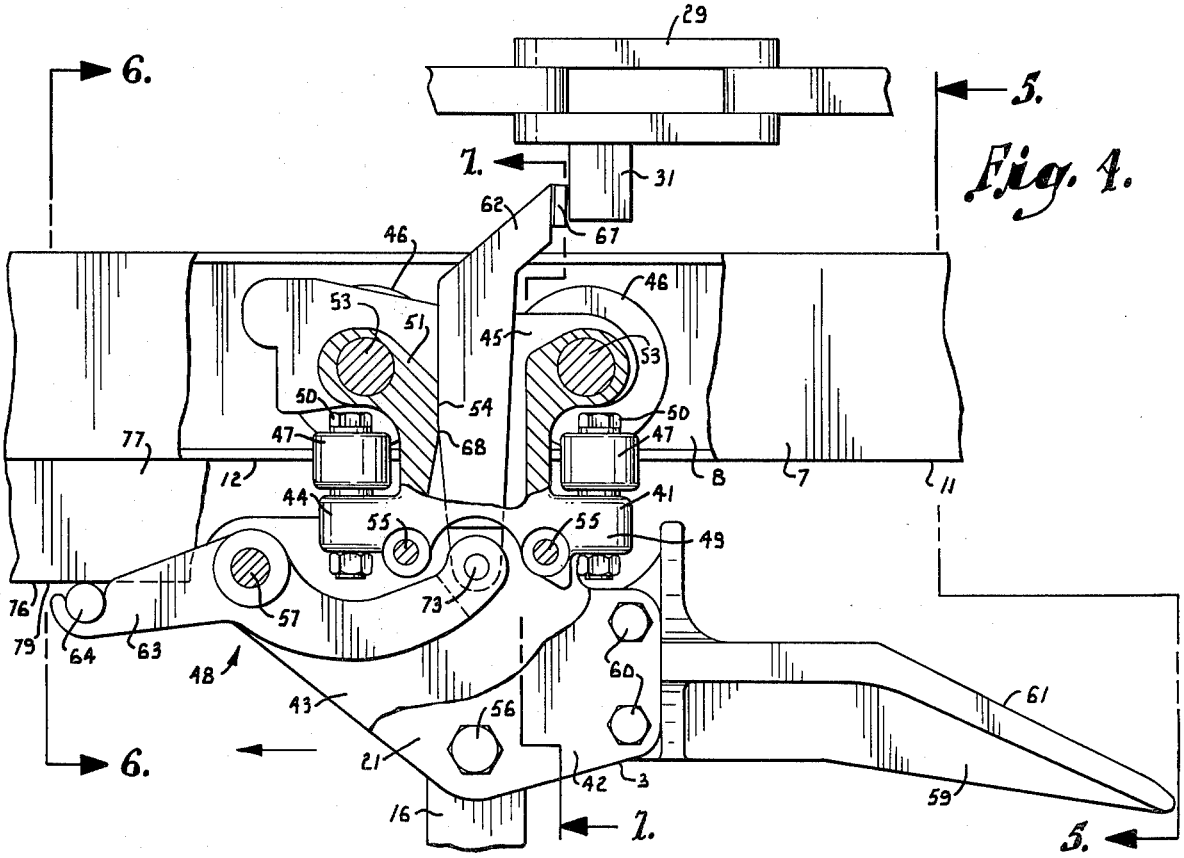
FIG. 4 is a side elevational view of the power and free conveyor system of FIG. 3 wherein the transfer dog is in a transfer position.

A cam surface 76 in association with the cam follower 64 operatively actuates the transfer dog 62 between the running position, as seen in FIG. 3, and the transfer position, as seen in FIG. 4. In the illustrated embodiment of the present invention, the cam surface 76 is positioned beneath the track 2. The cam surface 76, as is shown in FIGS. 3 and 4, is the lower edge of an elongated plate 77 which depends from and is aligned with the track channel member 8. As seen in FIG. 1, the cam surface 76 is preferably positioned under and slightly before the transfer area 39 and slopes downward from the track 2 at an acute angle in the nature of 15° beginning near the rearward end 78 thereof. The cam follower 64 engages, near one end thereof, the cam surface 76 upon entering the transfer area 39. The cam follower 64 rides on the cam surface 76 as it slopes away from the track 2, thereby biasing the cam follower 64 away from the track 2 and at the same time operably raising the transfer dog 62. A middle portion 79 of the cam surface 76 is horizontal to maintain the transfer dog 62 fully in the transfer position. The front end 80 of the cam surface again slopes toward the track 2 to disengage the transfer dog 62 from the first power system dog 31. As shown in FIG. 1, the cam surface front end 80 is perpendicular to the track 2; however, a more gradual slope may be used if it is desired to more slowly lower the transfer dog 62.

It is foreseen that the cam surface 76 may be very short and only used to raise and engage the transfer dog 62 with one of the first power system power dogs 31, since in many conveyor systems 1 the frictional forces between the transfer dog 62 and such a power dog 31 will maintain engagement therebetween, without the cam surface 76 biasing the transfer dog 62 into the transfer position. Once the transfer dog 62 is no longer biased upward by the cam surface 76 and/or becomes disengaged from the power dog 31, gravity normally returns the transfer dog 62 to the running position. A spring or other positive biasing device may also be used operably to return the transfer dog 62 to the running position or to keep the transfer dog 62 from accidentally being jiggled into the transfer position when such is undesired. Also, alternatively, the cam surface 76 may be formed by parallel plates depending from both track channel members 7 and 8 or by other suitable means.

In use of the transfer mechanism 48 according to the present invention and with regard to the portion of the power and free conveyor system 1 shown in FIGS. 1 and 2, the load 17 to be conveyed is suspended from the support beam 15 which is in turn pivotally suspended from two or more load bearing trolleys 3 forming a train or carrier. At least one of the trolleys 3 is a lead or power trolley 20 and one is a trailing or transfer trolley 21. The trolleys 3 are alternatively interconnected by other suitable means and the load 17 may be hung from only one or a couple of the load bearing trolleys 3 in the train. Each of the load bearing trolleys 3 rides within the track 2 and extends therebelow with only the drive dog 23 normally extended above the track 2, thereby creating a substantially clear profile above the track 2 and lessening the chance of accidental engagement with an external projection. The first power system 4 comprises an endless driven chain 29 having power dogs 31 depending therefrom and normally runs overhead of the track 2, such that power dogs 31 engage the primary or drive dog 23 on the lead trolley 20 and thereby propel the trolley train. Wherever transfer is desired to a second power system 5, the cam surface 76 is suitably positioned before and in the respective transfer area 39, such that the transfer dog 62 will be raised to the transfer position upon the cam follower 64 engaging the cam surface 76. Preferably, the transfer dog 62 is raised to the transfer position contemporaneously with the disengagement of the lead trolley 20 from the first power system 4 as same curves away from the track 2 in the transfer 39 area. The term "contemporaneously" is understood to mean "as soon as or very soon after". The transfer dog 62, now in transfer position, engages the next power dog 31 depending from the first power system 4 and, thereby continues to drive or propel the trolley train across the transfer area 39 at least a sufficient distance for the lead trolley 20 to engage another power dog 31 depending from the second power system 5. After the lead trolley 20 engages the second power system 5, the transfer dog 62 disengages from the power dog 31 depending from the first power system 4 as the cam follower 64 encounters the end 80 of the cam surface 76 and returns to the running position. It is possible that the transfer dog 62 disengages from a power dog somewhat before the lead or power trolley 20 reengages a power dog 31 on the second power system 5 in situations where sufficient momentum is developed to drive or propel the train the remaining distance until such reengagement occurs. Throughout the transfer the entire transfer mechanism 48 is positioned entirely beneath the track 2 except for the power dog 62.

Figure 9:
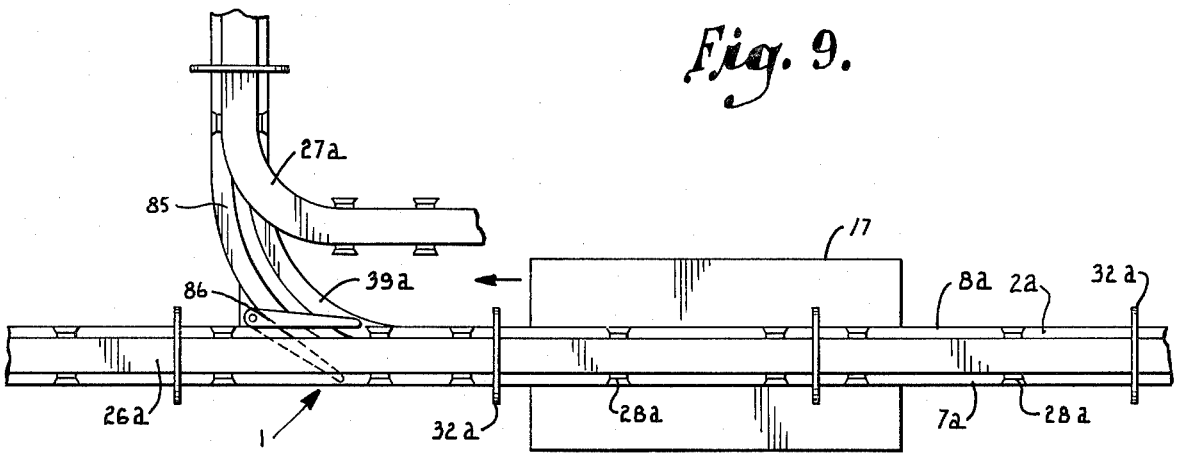
FIG. 9 is a top plan view of the power and free conveyor system wherein the load riding on the load bearing trolleys is approaching a gate controlled divergent path and wherein the trolleys pass through a transfer area between two power conveyor chains.
Figure 10:
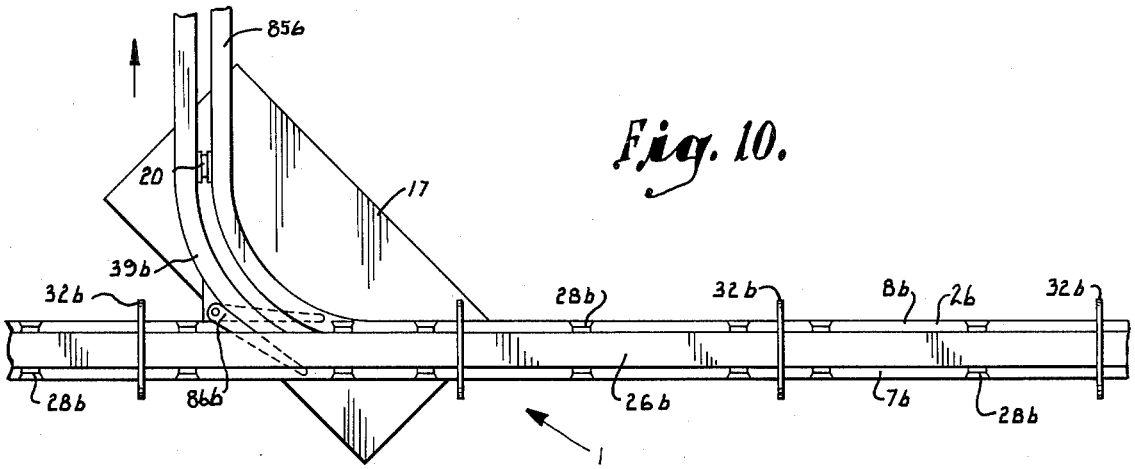
FIG. 10 is a top plan view of the power and free conveyor system wherein the load riding on the load bearing trolleys is transferring from the main track onto a side track wherein no power is applied to the trolleys.
Figure 11:
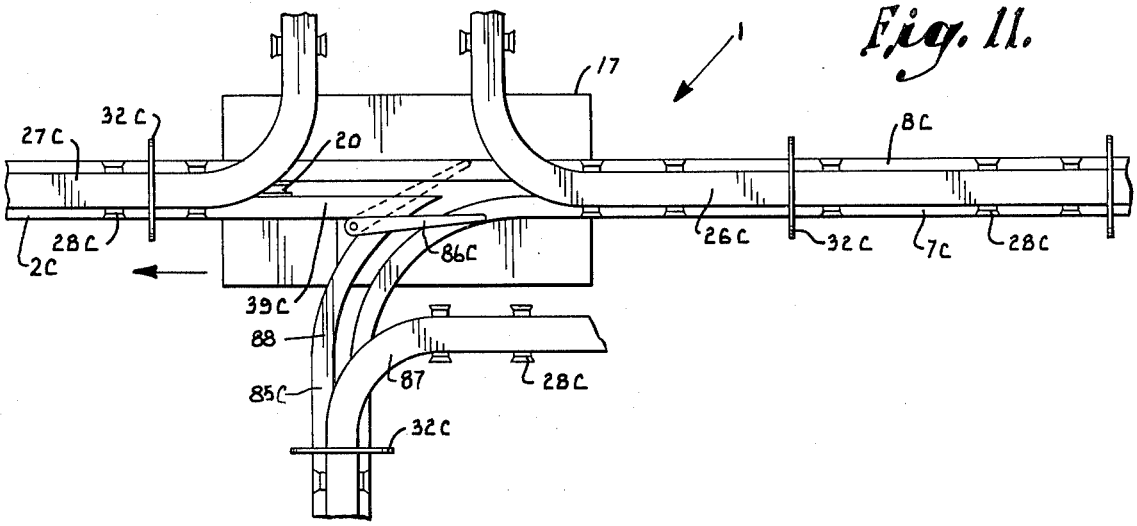
FIG. 11 is a top plan view of the power and free conveyor system wherein the load riding on the load bearing trolleys is passing through a gate controlled transfer area wherein the trolleys are transferred from a first power conveyor chain to one of two alternative power chains which are positioned over divergent portions of the track respectively.

The transfer mechanism 48, according to the present invention, is also suitable for transfers other than the particular one shown in FIGS. 1 and 2 and described hereinabove. The power and free conveyor system 1 may require a great many transfers and somewhat different transfers throughout various portions thereof. Additional examples of portions of the power and free conveyor system 1 requiring transfers are illustrated in FIGS. 9, 10 and 11. The various parts of portions of the power and free conveyor system 1 shown in FIGS. 9, 10 and 11 which correspond to the portion shown in FIGS. 1 and 2 have corresponding numbers except that the letters "a", "b" and "c" have been added respectively to differentiate between the various portions.

In the portion of the power and free conveyor system 1 shown in FIG. 9, a side track 85 diverges from the main track 2*a* which is comprised of channel members 7*a* and 8*a*. A first power conveyor track 26*a* having chain trolleys 28*a* is positioned above the main track 2*a* by track support beams 32*a*. A second power conveyor track 27*a* horizontally converges with and is spaced above the side track 85 at a location somewhat spaced from the main track 2*a*. A pivotal gate 86 operably directs the trolley train at the divergence of the side track 85 from the main track 2*a* so that the train follows one of the paths. In this illustration the region of the side track from the main track to where the second power conveyor track 27*a* converges therewith is designated the transfer area 39*a*.

With reference to FIG. 9, a load 17 carried by trolleys (refer to the trolleys 3 illustrated in FIG. 1) travels along the track 2*a*. When it is desired to switch the load to the side track 85, the gate 86 swings to the position shown in phantom and the trolleys with their attached load 17 follow the side track 85. The lead trolley (refer to lead trolley 20 and the transfer trolley 21 associated with the load 17 as seen in FIG. 1) enters the side track 85 and disengages from one of the power dogs (not shown) associated with the power conveyor track 26*a*, thereby becoming undriven. At this time the transfer dog 62 is operably raised (refer to FIG. 4) so as to engage one of the power dogs associated with the power conveyor track 26*a* as was previously discussed regarding a transfer through the portion of the power and free conveyor system illustrated in FIGS. 1 and 2. In this manner the transfer dog 62 propels the load 17 and associated trolley train until the lead trolley 20 proceeds along the side track 85 a sufficient distance to be engaged by one of the power dogs (not shown) associated with the power conveyor track 27*a*. Thus the transfer dog propels the load 17 and associated trolley train through the transfer area 39*a*.

FIG. 10 illustrates diversion of the load 17 and associated trolley train to a side track 85*b* having no associated overhead power conveyor. The main track 2*b* and associated power conveyor track 26*b* is similar to that described for like parts shown in FIG. 9. An operable gate 86*b* selectively diverts the train trolleys, such as lead trolley 20, onto the side track. In diverting the load 17 to the side track 85*b*, the lead trolley 20 becomes disengaged from one of the power dogs (not shown) associated with the power conveyor track 26*b*. The transfer dog 62 is raised (as in FIG. 4) to engage another of the power dogs (not shown) associated with the power conveyor track 26*b*, thereby driving the load 17 and associated trolley train through the transfer area 39*b*. In this situation the transfer area 39*b* comprises sufficient distance along the track 85*b*, such that the transfer trolley 21 clears the main track 2*b*. Preferably the load 17 and associated trolley train completely clear the main track 2*b* so that a second load (not shown) may be carried by the main track 2*b* without engaging the load 17. Normally the momentum of the load 17 will propel the load 17 and associated trolley train clear of the main track 2*a* after the transfer dog 62 becomes disengaged from one of the power dogs (not shown) associated with the power conveyor track 26*b*; however, in some cases the transfer trolley 21 must be positioned somewhat behind the load 17 so as to insure the load 17 clears the track 2*b*.

A portion of the power and free conveyor system 1 is illustrated in FIG. 11 wherein the load 17 and associated trolley train (including lead trolley 20) pass between two power conveyor tracks 26*c* and 27*c* alternatively divert to a side track 85*c* whereupon they are powered by a third power conveyor system associated with a third power conveyor track 87. The various parts of this portion of the power and free conveyor system have the same function as similarly numbered parts in FIGS. 2 and 9. The load 17 and associated trolley train are selectively diverted by gate 86*c*. Here, as before, the lead trolley 20 becomes disengaged from one of the power dogs (not shown) associated with the first power conveyor track 26*c* as the power conveyor track 26*c* diverges from the main free track 2*c*. The transfer area is actually alternatively comprised of two regions depending upon the path followed by the load 17, these being a track region 39*c* between the first power conveyor track 26*c* and second power conveyor track 27*c* and the track region 88 between the first power conveyor track 26*c* and the third power conveyor track 87. Again the transfer dog 62 (see FIG. 4) is raised when the lead trolley 20 becomes disengaged from one of the power dogs (not shown) associated with the power conveyor track 26*c* and propels the load 17 and associated trolley train through one of the transfer areas 39*c* and 88 respectively until the lead trolley 20 engages one of the power dogs (not shown) associated with power conveyor tracks 27*c* and 87 respectively.

It is to be understood that while certain embodiments of the present invention have been illustrated and described, it is not to be limited to the specific forms or arrangement of parts herein described and shown except insofar as such limitations are included in the following claims.

Having thus described the invention, what is claimed and desired to secure by Letters Patent is:

1. In a power and free conveyor system including:

a load supporting track;

a train of interconnected trolleys riding on said track; one of said trolleys being a power trolley and one of said trolleys being a transfer trolley; at least one power means being a first power means and being positioned above said track and having power dogs depending therefrom; and said power trolley normally being driven by one of said power dogs of said first power means when said power trolley is beneath said first power means;

the improvement being means for transferring said train through at least one transfer area wherein no power is applied to said power trolley by said power means, said transferring means comprising:

(a) a transfer dog connected to said transfer trolley and having a running position and a transfer position;

said transfer dog normally being in said running position, such that said transfer dog will not engage one of said power dogs of said first power means; said transfer dog being capable of displacement upwardly into said transfer position, such that said transfer dog will engage one of said power dogs of said first power means;

(b) an operating lever being pivotally connected at a medial point therealong to said transfer trolley and at one end thereof to said transfer dog;

(c) a cam follower being carried by the other end of said operating lever; and (d) a cam having a cam surface positioned below said track; said cam follower engaging said cam surface whenever transfer of said train through one of said transfer areas is required, thereby operatively raising said transfer dog from said running position to said transfer position; whereby said transfer dog engages one of said first power means power dogs, thereby driving and transferring said train through said one transfer area.

2. The conveyor system according to claim 1 wherein:

(a) said track comprises two longitudinal channel beams having inwardly directed upper and lower flanges and being in parallel spaced relationship with respect to one another;

(b) said transfer trolley comprises a body portion and pivotally attached vertically oriented wheels; said body portion being at least partially positioned between said channel beams; said wheels riding on the bottom flanges of said channel beams;

(c) said body portion including a substantially vertical bore therethrough;

(d) said transfer dog extending through said bore and being held in a vertical position thereby; and (e) said operating lever and said cam follower being positioned entirely beneath said track.

3. The conveyor system according to claim 2 wherein:

(a) said body portion includes a pocket suitable for receiving the upper part of said transfer dog whereby said transfer dog is held in said pocket beneath said channel beam upper flanges when said transfer dog is in said running position.

4. The conveyor system according to claims 1, 2 or 3 wherein:

(a) said transfer trolley extends below said track;

(b) said operating lever is positioned below said track; and (c) said operating lever is pivotally attached to a lower end of said transfer dog and extends forwardly therefrom with respect to the normal motion of said transfer trolley.

5. The conveyor system according to claims 2 or 3 wherein:

(a) said cam surface comprises the lower edge of at least one vertically aligned member depending from one of said channel beams; and (b) said cam surface is selectively positioned along said track such that said transfer dog is urged into the transfer position substantially contemporaneously as said power trolley is released by said first power means.

6. The conveyor system according to claim 5 wherein:

(a) said cam surface extends along said track such that said transfer dog is maintained thereby in said running position at least until said trolley train substantially clears said first power means.

7. The conveyor system according to claim 6 wherein:

(a) said cam surface has at least one end section forming an acute angle with respect to said track, whereby said transfer dog is raised smoothly, and a center section substantially parallel to said track, whereby said transfer dog is held at a constant vertical position relative to said track while in said transfer position.

8. The conveyor system according to claim 7 wherein:

(a) said cam surface end section forms an angle of about 15° with respect to said track.

9. The conveyor system according to claim 5 wherein:

(a) said cam follower is at all times substantially vertically spaced from said track, whereby said cam follower does not ride on and wear said track.

10. The conveyor system according to claim 5 wherein:

(a) said cam follower comprises an elongated bar fixedly attached at a medial point thereof to the forward end of said operating lever;

(b) said cam follower extends horizontally and transversely with respect to normal motion of said transfer trolley; and (c) said cam follower engages near at least one end thereof said cam surface.

11. The conveyor system according to claim 5 including:

(a) second power means having power dogs depending therefrom and being positioned above said track sequentially with respect to said first power means and with said transfer area therebetween;

(b) said transfer dog is held in said transfer position in engagement with a power dog of said first power means by friction therebetween, until such time as said power trolley engages a power dog of said second power means at which time said transfer dog becomes unengaged from said first power means and returns to said running position due to the force of gravity.

* * * * *